US008657674B2

(12) United States Patent
LeMay et al.

(10) Patent No.: US 8,657,674 B2
(45) Date of Patent: Feb. 25, 2014

(54) CREDIT RETURN TO PLAYER DURING FAULT CONDITION ON GAMING MACHINE

(75) Inventors: Steven G. LeMay, Reno, NV (US); Dwayne R. Nelson, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/415,691

(22) Filed: Mar. 8, 2012

(65) Prior Publication Data

US 2013/0237310 A1 Sep. 12, 2013

(51) Int. Cl.
*A63F 9/24* (2006.01)

(52) U.S. Cl.
USPC ..... 463/25; 463/42

(58) Field of Classification Search
USPC ..... 463/25
See application file for complete search history.

(56) References Cited

U.S. PATENT DOCUMENTS 6,450,884 B1 * 9/2002 Seelig et al. ..... 463/17
2002/0045476 A1 * 4/2002 Poole et al. ..... 463/25
2002/0142824 A1 * 10/2002 Kazaoka et al. ..... 463/16
2002/0151356 A1 * 10/2002 Burns et al. ..... 463/25
2003/0032485 A1 * 2/2003 Cockerille et al. ..... 463/43
2006/0170154 A1 * 8/2006 Matsuno et al. ..... 273/142 R
2007/0167226 A1 * 7/2007 Kelly et al. ..... 463/29
2010/0190554 A1 * 7/2010 Gagner et al. ..... 463/42

* cited by examiner

*Primary Examiner* — Tramar Harper
(74) *Attorney, Agent, or Firm* — Foley & Lardner LLP

(57) ABSTRACT

A credit amount is returned to a wager game player on a gaming machine when a game experiences a fault condition. The credit amount is displayed automatically and the player can accept the return credit amount and resume game play without intervention from a gaming operator attendant, allowing the patron to resume game play within a short time after the fault occurred. The fault occurs during game play and a return credit amount is calculated using all relevant data available on the gaming machine at the time of the fault. The amount is displayed to the patron and the patron is queried whether the amount is acceptable. If it is, the patron can indicate so by pressing a soft key, be credited with that amount, and immediately resume game play. If not acceptable, the patron can indicate so and a gaming operator is signaled.

17 Claims, 5 Drawing Sheets

CREDIT RETURN TO PLAYER DURING FAULT CONDITION ON GAMING MACHINE

BACKGROUND

1. Field of the Invention

The described embodiments relate generally to wager gaming machines. More particularly, they relate to returning credits to players when a fault condition occurs during game play on a gaming machine.

2. Description of the Related Art

Presently, when a game experiences a fatal error on a gaming machine, it is likely to cause the machine to crash and creates what is sometimes referred to as a "red screen." In some scenarios, this error is fatal meaning that the machine does not recover. When this happens the player's credit balance is, in most cases, unknown. The player disputes the amount with the operator and the operator is likely to refund money, depending on the amount. This process is imperfect since the amounts are not exact and the process is time consuming. This way of handling game errors also keeps the player away from playing while the amount in dispute is being settled. Also, the money given to the player may not be accounted for correctly or reconciled with a host server. Currently, the casino operator approaches the problem by taking the least expensive (and least resistant) route to resolving the problem and getting the patron back to playing on the gaming machines. This is often done by negotiating a certain amount with the patron and, if the amount is not over a certain threshold, giving the casino attendant the discretion to return credits to the patron and resolve the problem, known as a "hand-pay."

When there is a critical or severe error, the gaming machine may re-load and start. In the process and as a result of an operator turning a key to open the machine, it loses most if not all of the credit data it had stored, typically in non-volatile memory. In some cases, game state information is transmitted to a host server. If an error occurs in the middle of a game (e.g., while a wheel is spinning), the server is normally not informed of what happened until the game is done. This is because the server does not need to know what is happening in the middle of the game, only what the state is at the end of the game. If there is an error on the gaming machine in the middle of the game, the server will want to know if the game has ended, otherwise the data on the server is unresolved and further game play may be disabled. The host server may know what the initial credits were, but will not know the how many credits there were or the amount of any bets, wins, or bonus amounts in the middle of a game. In this case, there is no expedient and accurate way to reconcile the credit amounts on the gaming machine and on the server. It would be preferable to make it easier to reconcile the amounts and resolve any problems, that is, have a self-service or automated version of a hand-pay.

SUMMARY OF THE DESCRIBED EMBODIMENTS

One aspect of the present invention is a method of method of returning credits to a patron playing a wager game on a gaming machine when a fault occurs during game play. It does so in a manner that does not require intervention of an attendant and efficiently resolves issues related to the fault so that the player can resume game play on the same gaming machine as quickly as possible. In one embodiment, the initial credit amount and a bet amount are stored in non-volatile memory on the gaming machine, including Flash memory and hard drives, and game play proceeds when an error is detected on the machine. A return credit amount is calculated by logic on the gaming machine using all available credit, bet, win, and bonus data on the machine and, if available, on a host server. The return credit amount is displayed on the machine and the patron is queried as to whether the amount is acceptable. If it is, the patron is automatically credited with the amount and game play continues on the machine without intervention from a gaming attendant.

Another aspect of the present invention is a method of processing an error during game play on a gaming machine. A player is playing a game on the machine and the game stops due to a fault. The cause of the fault may be any type of fault that occurs on a gaming machine varying from hardware issues to soft tilts. Once the fault or error occurs, the gaming machine calculates a credit amount to return to the player using data stored in the machine and, if available, on a host server. The credit amount is displayed on the gaming machine and the player may enter a response either accepting the amount or declining it and signaling for an attendant. The machine detects a response from the player and if the player accepts the amount, game play resumes on the gaming machine. If the game that was executing has not been disabled, the player has the option of continuing play of the same game or may select another game on the machine if multiple games are offered.

BRIEF DESCRIPTION OF THE DRAWINGS

The embodiments will be readily understood by the following detailed description in conjunction with the accompanying drawings, wherein like reference numerals designate like structural elements, and in which.

DETAILED DESCRIPTION

Methods and systems for returning credits to a player who is in the process of playing a wager game on a gaming machine when an error condition occurs are described in the various figures. In one embodiment, the player encounters a fault at some point between the start and the end of playing a game (referred to herein as "middle of game") on a gaming machine and is presented with a return credit amount on the display of the gaming machine. The player has the option of accepting this return amount and, if accepted, continuing game play of either the same game or a different game on the machine without having to wait for an attendant. The entire process is automated. In another embodiment, the gaming machine may also prompt for a casino attendant who can examine the various values that are used in calculating a return credit amount, settle on a return amount with the player (i.e., negotiate with the player), and enter this new amount (or possibly the same amount that was displayed initially) in the machine. The player can then resume playing the game or, if available, a different game on the machine. Referring to the first embodiment (the fully automated method), a casino attendant may be prompted if the player does not agree to accept the return credit amount that is automatically displayed. Various other embodiments and scenarios are described in the figures below. For example, the severity of the error condition or the amount of the return credits may lead to special circumstances where an automatic offer to return credits to the player may not be desirable by the casino. One common feature in most of the embodiments described is that the player be able to resume game play, preferably of the same game, on the same machine in as short a time as possible. That is, the error condition is resolved and credits are returned to the player as expeditiously as possible, preferably with minimum or no assistance from a casino attendant.

Figure 1:
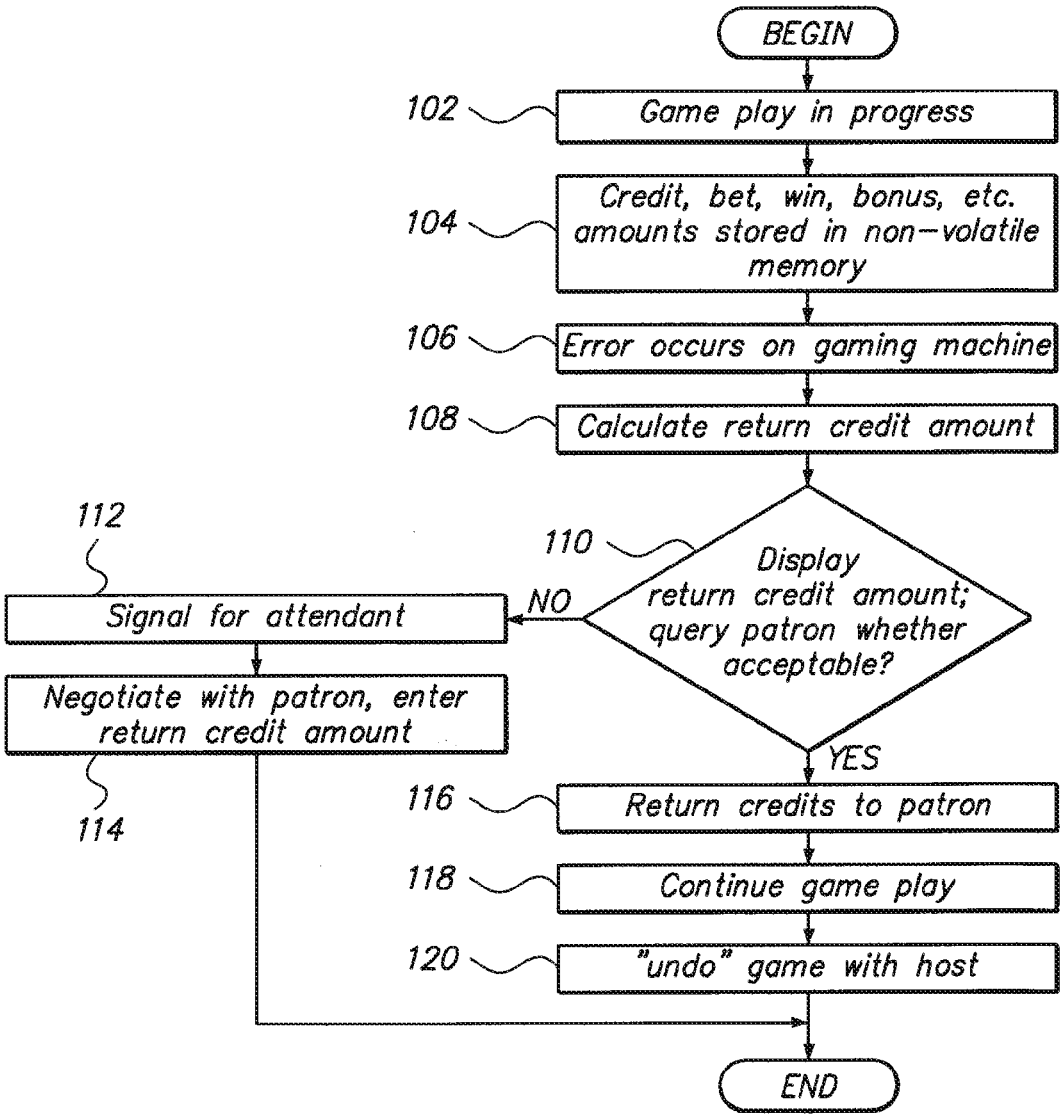
FIG. 1 is a flow diagram showing an overview of a process of returning credits to a player playing a game on a gaming machine which encounters a fault condition during game play in accordance with one embodiment.

FIG. 1 is a flow diagram showing an overview of a process of returning credits to a player playing a game on a gaming machine which encounters a fault condition at some point between the start and the end of game play in accordance with one embodiment. At step 102 a player is playing a wager game on a gaming machine. The gaming machine or device may be any type of electronic device which offers one or more games in which a player places a bet from credits she has deposited in the gaming machine. At step 102, a player has a certain credit amount, may have placed a bet, may have a win amount and a bonus amount, and has started a game (e.g., spun a wheel, pulled a lever, been dealt cards, and the like). Game play is in progress. If the gaming machine is connected via a network to a host server, the gaming machine has already transmitted a game start event to the host so the host is aware that a game is in progress on that particular gaming machine.

At step 104, which may occur at the same time as step 102, the various amounts, namely credit, win, bet, and bonus amounts, are stored in non-volatile memory on the gaming machine. As known to a person skilled in art of gaming systems, these amounts are stored at various times during game play, typically when they are made available, often by the user (i.e., when a user selects a bet amount or inserts money for an initial credit amount). In addition to these amounts being stored in memory on the gaming machine, such as in NV-RAM, Flash memory, a hard drive, and any other type of persistent memory device, they may also be stored elsewhere on or off the gaming machine at generally the same time. In one embodiment, some of the amounts, such as the initial credit amount, may be transmitted to the host server. Whether any of these amounts are transmitted to a host server while a game is in progress is a decision made by the gaming operator and may not be done in many casinos. In another embodiment, some or all of the amounts, in addition to being stored in non-volatile memory, may also be stored in another type of memory (or a different non-volatile memory) on the gaming machine, such as on a hard drive, non-persistent memory, cache, or any other type of memory in the gaming machine. One of the advantages of storing the amounts in a separate memory is so they can be used in forensics when investigating why a game or gamine machine may have crashed or experienced a fault.

At step 106 an error occurs on the gaming machine during game play. As is known in the art, there are different types of errors. For example, there are errors or faults that can be classified as "soft tilts" (e.g., the machine is low on paper) where a player may continue playing a game. Another classification is "tilt" where game play stops while the problem is being fixed. Another type of fault may be a logic error where, for example, credit amounts or other amounts cannot be reconciled, that is, the accounting does not add up, and game play is stopped immediately. Currently, most gaming machines have software for detecting an error and, if possible, unloading and re-starting the machine, which can be a relatively time-consuming process (e.g., 5 minutes or longer) which may be too long to keep a player waiting. The error may be in the software or hardware of the machine and may require an un-load and re-start, also referred to as a "cold start," of the game that was in progress or of the gaming machine. As described in detail below, the severity of the error may be examined to determine how to proceed with respect to returning credits to the player. It should also be noted that some errors may be so severe that non-volatile memory is unintentionally cleared or must be cleared, as a result of the error, by an operator who, for example, may have to "turn a key" to open the box, in order to proceed, such as with a cold start of the gaming machine.

At step 108, logic on the gaming machine calculates a return credit amount. On some gaming machines, software for calculating this amount is presently implemented. Assuming that non-volatile memory has not been cleared, the amounts needed for calculating the number of return credits are retrieved and used in the determination. This may be as simple as taking the total of the current number of credits at the time of the error and the current bet amount. In other scenarios it may involve taking win amounts and bonus amounts into consideration. As described below, the amounts needed are most likely retrieved from non-volatile memory on the machine, but the software may also rely on data from a host server or, if available, from the additional storage space on the machine.

At step 110, two items are displayed on the gaming machine. The return credit amount calculated at step 108 is displayed to the player, for example, in a service interface window. Also displayed is a statement to the player stating that there was an error during the previous game and that the credit amount to be returned as calculated by the casino is the amount displayed. This may be followed by querying the player whether this credit amount is acceptable? For example, the following may be displayed: "An error occurred during game play. The amount to be returned to you is 98 credits. [ACCEPT] [DO NOT ACCEPT; CALL ATTENDANT]." The player can press a soft key in the service interface window or another button on the machine to accept the amount.

If the player does not want to accept the return amount for any reason, he can press the DO NOT ACCEPT soft key or similar button and signal for an attendant at step 112. An attendant may be signaled to the gaming machine using conventional means and at step 114 the attendant (representing the gaming operator) can negotiate with the player regarding the credit return amount and either enter a new amount in the machine or, if they arrive at the original credit amount, confirm that amount. The attendant has access to most or all the stored amounts and can use this data, which may be stored in the machine's memory or, in some cases on a server, to negotiate a return credit amount to the player. In most cases, it is likely that the attendant will use the same data that the machine used to arrive at the displayed return credit amount and may proceed to explain to the player that this is the correct amount of the return and move forward in the negotiation from there. The goal for the casino operator here is to provide the attendant with as much data as possible about the various amounts stored in the machine and possibly on a server at the time of the error. If an agreement is reached, the player can then continue game play on the machine at step 118.

If at step 110 the player accepts the return credit amount offered by the gaming machine, at step 116 the return credit amount is credited to the player using conventional means in the gaming machine and the player continues game play at step 118. When game play initiated (i.e., prior to step 102 above), a host server, assuming the gaming machine is in a network, was informed of a game start event; the server knows that a game has started on a particular gaming machine.

As noted above, the server is generally not informed of intermediate game states, such as bet amounts, bonus wins, actions taken by the player during the game, and the like. It is typically informed when the game ends and the credit amount the player has at that time. When an error occurs during play at some point between the beginning and end of a game, the server is not informed. It is in a suspended state and waits for a logical conclusion to the game start event, specifically a game end event. If it does not get one, the server is in an un-reconciled state, without a logical or expected conclusion.

At step 120, a game end event signal is sent to the server so that it is not in a suspended state with respect to that particular game. This may be referred to as sending an "undo game" message to the server given that all the information for the particular game that was started but then experienced an error is being reversed or essentially undone. This functions as a logical game end event for the server. The primary importance of this step is to settle the accounting on the server and the gaming machine. Stated simply, all the credit amounts need to be reconciled and all the values with respect to accounting, taxes, and other matters need to add up. In one embodiment, the gaming operator reconciles, for example, the cash-in and cash-out amounts on the machine so that the accounting data on the machine is consistent with the data on the host server. In some embodiments, this may be done by the attendant via a service window interface on the gaming machine or remotely by an attendant using a mobile device. The device can be used to query the accounting system and perform the "undo" of the game so that the player can continue game play on the machine with all credit balances resolved in the player's mind and reconciled in the casino operator's accounting system.

Figure 2:
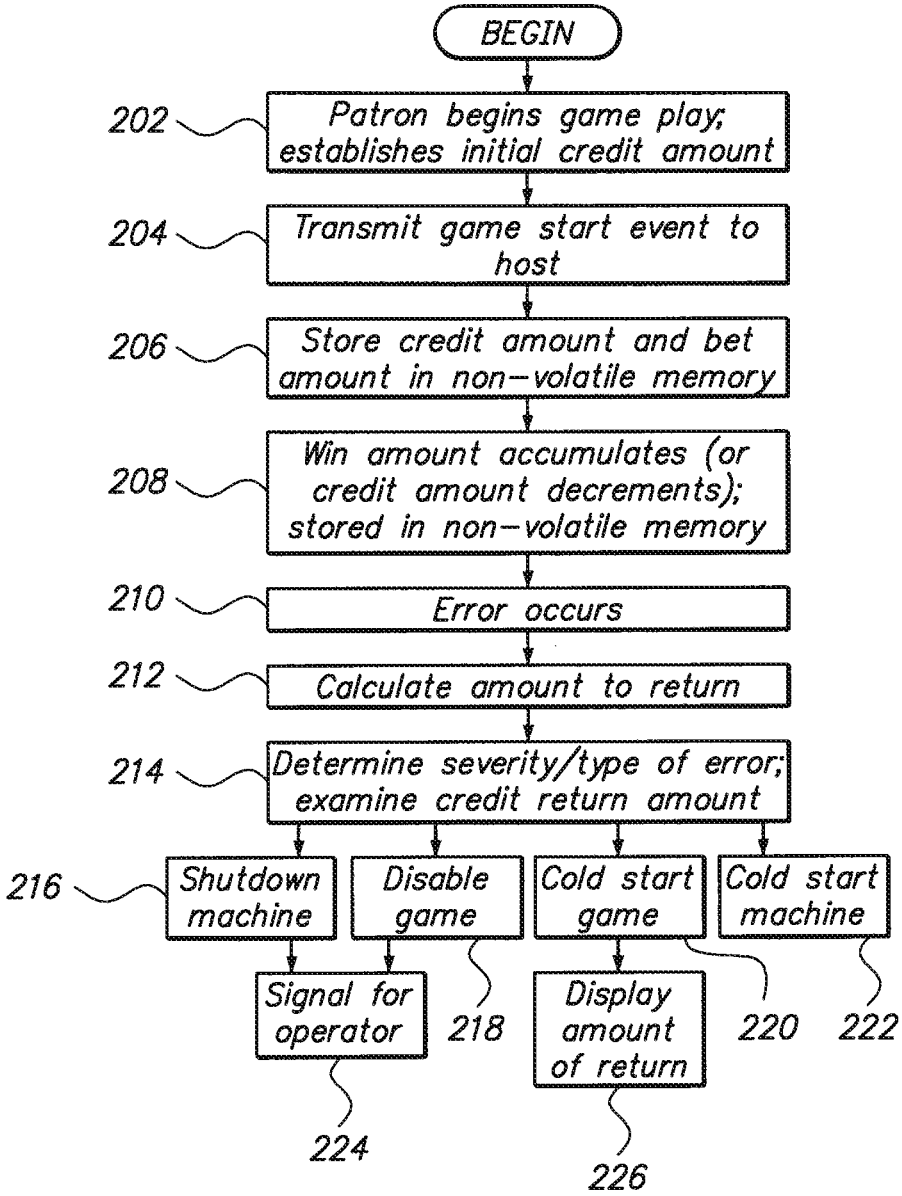
FIG. 2 is a flow diagram of a process in a gaming machine of displaying a return amount or signaling for an operator when an error occurs during game play in accordance with one embodiment.

FIG. 2 is a flow diagram of a process in a gaming machine of displaying a return amount or signaling for an operator when an error occurs during game play in accordance with one embodiment of the present invention. At step 202 the player establishes an initial credit amount on a gaming machine with the intention of beginning game play. At step 204 the gaming machine transmits a game start event to a host in the gaming network, described in greater detail in FIG. 5. The properties and format of this message may vary depending on gaming machine and network protocols. The host is now informed that a game has started on a specific gaming machine and knows the initial credit amount. The gaming machine may offer several different types of games (e.g., Keno, poker, blackjack, and so on) and the host knows that a specific game, such as "Deuces Wild Poker" has started on a particular machine and that the player has established an initial credit amount.

At step 206 the gaming machine stores the credit amount and a bet amount (which the host typically does not have) in non-volatile memory. Other amounts that may be entered by the player or determined by the machine that are relevant to game play may also be stored at this time. During game play, at step 208 a win amount accumulates and is added to the credit amount or the credit amount is decremented due to losses. These amounts are stored in non-volatile memory in the gaming machine and are typically not transmitted to a host. In other embodiments, wins, losses, bet amounts, and other values may be transmitted to a host server.

The player continues with game play and at some point during the game, for example when selecting a bet amount, selecting which cards to hold in poker, pressing a "HIT" button in Blackjack, to name but a few examples out of many, an error occurs in the gaming machine at step 210. At step 212 the gaming machine calculates an amount to be returned to the player. There are methods known in the art of gaming machine operation to calculate this amount using values stored in non-volatile memory. Steps taken when the error requires that non-volatile memory be cleared or is cleared due to the error are described below. The calculation may use the amounts (credit, bet, win, bonus, etc.) that are stored on the machine during game play to arrive at a return amount.

At step 214 the gaming machine determines the severity of the error that occurred and the type or category of the error. In some embodiments, the gaming machine may consider the amount of the credit return calculated at step 212 in determining the severity or category of the error. For example, if the credit return amount is over $2,000, the error may be considered in a special category or it may elevate the severity level of the error. Similarly, if the return amount is less than a threshold amount, for example $20, then it may be classified accordingly. In other embodiments, step 214 may be done before or at close to the same time as step 212. There may be various severity levels and types of errors that may occur in a gaming machine. In one embodiment there are four actions that may be taken depending on the severity and type of error. These include shutting down the entire gaming machine (step 216), cold starting (unloading and re-starting) a gaming machine (step 222), disabling the specific game or the only game that was being played on the machine at the time of the error (step 218), and cold starting (unloading and re-starting) the specific game (step 220). In other embodiments, there may be additional or fewer actions that are taken depending on the error. As described in more detail below, the frequency of the error occurring in a particular game or on a particular machine may also be taken into account when determining which action to take. If a game or gaming machine crashes too often, the casino operator will want to take appropriate, probably more drastic action, such as disabling or shutting down.

If there is an error in the hardware of the gaming machine, the casino operator does not have any practical choice but to shutdown the machine. Presently, there is logic in the gaming machine to determine categories of errors or faults that occur (e.g., hardware error or software error). Generally, the casino operator wants to keep the machine up and running and make the game that the player was playing this available, so that he can continue game play with minimal interruption. In the embodiment shown in FIG. 2, step 220 where the game software is re-loaded and started is the least disruptive action that may be taken when faced with an error. If the error is more severe, the game may be disabled and the player is allowed to select another game on the machine and continue playing. This can be done relatively quickly since the other games are loaded and can be played at any time. Cold starting the entire gaming machine at step 222 will likely require the player to wait at least a few minutes before being able to play on the same machine.

The steps that follow may vary widely at different casinos. One embodiment is shown in FIG. 2. As noted, the most desirable resolution of an error is having the player accept the return credit amount displayed and continue game play of the same game in as short a time as possible without intervention of an attendant or operator. Of the functions that may be performed in the previous steps (216-222), cold starting a game or a machine may not require the need for human intervention. As such, if the player accepts the return credit amount, he can continue game play on the machine without signaling for an operator. This is shown at step 226 where the return amount is displayed on the machine waiting for a reply from the player. An attendant is not needed unless the player declines the return amount, as described in FIG. 1. The gaming machine signals for an attendant at step 224 if the gaming machine shuts down or the game is disabled.

Figure 3:
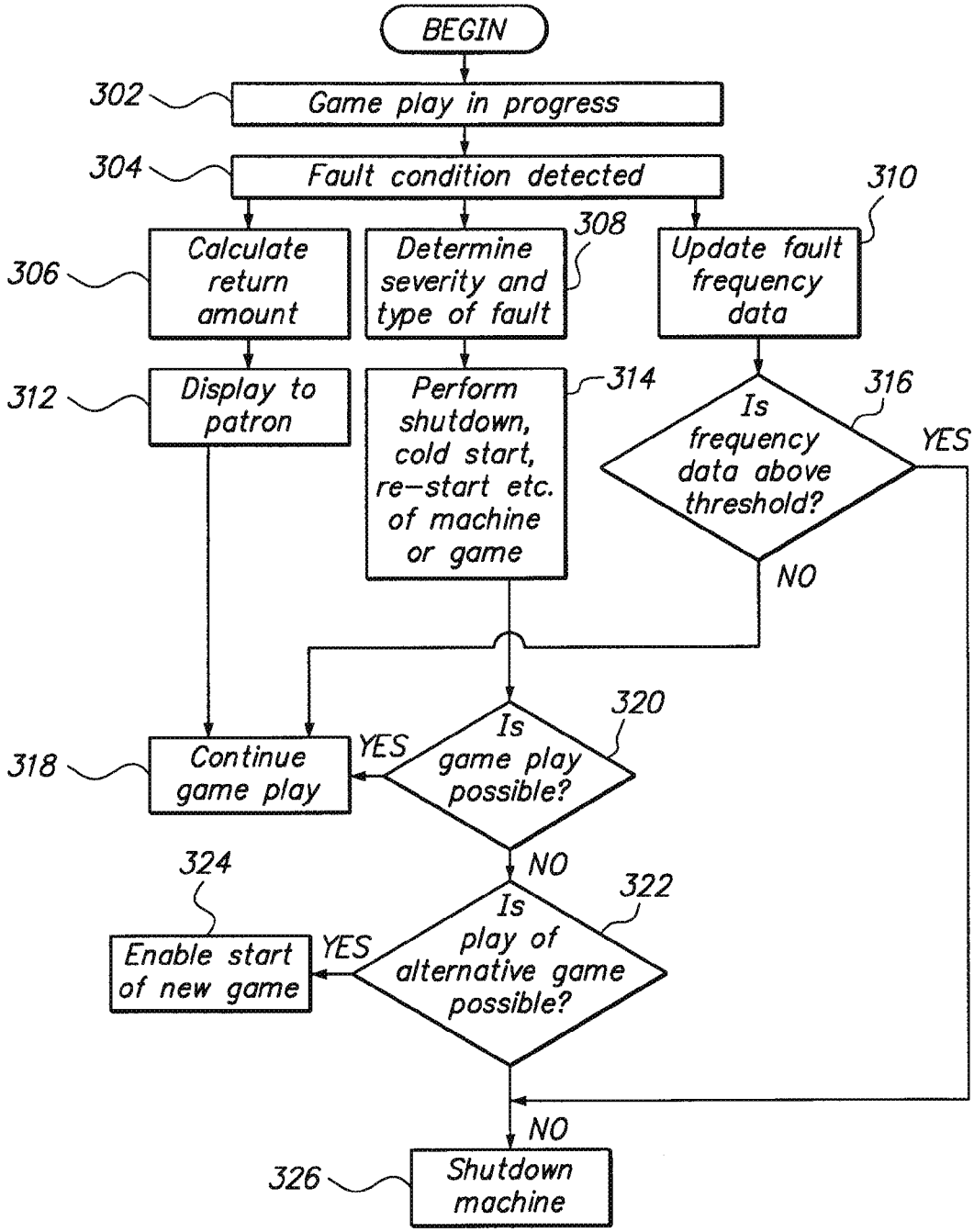
FIG. 3 is a flow diagram of a process of determining error or fault types and taking appropriate actions on a gaming machine related to returning credits to a player.

FIG. 3 is a flow diagram of a process of determining error or fault types and taking appropriate actions on a gaming machine related to returning credits to a player. Some of the steps shown in FIG. 3 are described in the previous figures but may be used to describe different embodiments or are used to go into more detail on certain features of the present invention. At step 302 game play on a gaming machine is in progress. The gaming machine is at a stage between the beginning and end of a game cycle. At step 304 a fault condition either in the gaming software or in the gaming machine hardware occurs during the game cycle.

Once the fault condition is detected, one or more functions are carried out, most or all of which are done generally concurrently. In one embodiment, these steps include step 306 of calculating a return amount, step 308 of determining the severity and type of fault, and step 310 of updating fault frequency data. At step 306, software on the machine calculates a return amount using game state data stored on the machine and possibly on a host server. Calculating a return amount may not always be possible depending on the type of error that occurred on the gaming machine, as described in step 308 and 314 below. If a return credit amount cannot be calculated, the gaming machine signals for an attendant. At step 312 the return credit amount is displayed to the player, for example, via a service window interface. If the patron accepts the amount, game play continues at step 318.

At step 308 the gaming machine determines the severity and type of the error. In some embodiments, this may be seen as two separate steps. The severity of the error may range from a potentially fatal, "red screen" type error where the gaming machine cannot recover from the fault to a minor error, such as "soft tilt." In the "red screen" case, the return amount may not be displayed or calculated (steps 306 and 312) and any further action must be taken by the gaming operator. A soft tilt may not require any immediate action by the machine or an operator but acts as a warning that attention will be required. The range of severity of a fault can vary on different machines and can also vary depending on the game being played. Some may be classified as a tilt, or more generally as a software fault or a hardware fault, which may be more difficult to recover from. Separate from the severity of the fault, the type of fault may also be important in determining how to proceed. As is evident from this description, a fault type may be inherent or inferred from the severity. Stated simply, at step 308, the gaming machine makes an assessment as to how bad the error is.

Based on this assessment, at step 314 the gaming machine performs a specific function, such as a shutdown or a cold start of the machine or game, or continues operation without a shutdown or cold start. In other embodiments, other actions may be implemented, depending on the type of machine, whether it is connected to a network (e.g., server-based), the type of game, whether the machine supports multiple games, and so on. From step 314 the gaming machine determines whether further game play is possible at step 320. If there is cold start of the machine or of the game that was being played, then further game play is likely and control goes to step 318 where game play continues. However, if the game that was being played or the gaming machine is shutdown and game play is not possible, then control goes to step 322. In one embodiment, the game that was being played is disabled and, at least temporarily, not offered to players. At step 322, the gaming machine determines whether other games on the machine (if available) may be played. This may be possible if the specific game that was being played is shutdown and disabled as opposed to the entire gaming machine. If alternative game play is possible, control goes to step 324 where the gaming machine offers the player the chance to start a different game on the same machine. If the player accepts the return credit amount, he can simply continue playing a different game. This is still a positive outcome for the casino operator given that the player is continuing game play on the same machine. If alternative game play is not possible (because the gaming machine has already or will be shutting down) or not offered, control goes to step 326 where the machine is shutdown.

Another function that may be performed upon detecting an error condition is updating fault frequency data. If a certain type of fault occurs too often with respect to a game or with the machine, the casino operator may decide to shutdown the machine or game to avoid disappointing or angering its patrons. A casino can decide that if a game has any type of fault or certain faults too often during a given time period or no particular time period, it should be disabled. To implement this, in one embodiment a counter may be maintained for each specific fault type that may occur within the gaming machine and for each game on the machine. This is shown at step 310. How the counters are implemented, whether time is a factor, the level of granularity (i.e., the number of counters), and other factors can be decided by the casino operator and the gaming machine manufacturer. Generally, whenever a fault occurs, at least one or more counters are incremented and other properties or data about the fault may also be stored. For example, in one embodiment, whenever a fault occurs, a record may be created wherein fields in the record represent different properties of the fault.

At step 316 logic in the gaming machine determines whether one or more counters has exceeded a threshold. The gaming machine may check whether the threshold was exceeded within a certain time period (e.g., resetting the counter after 40 days) or may not take time into consideration (e.g., the counter does not reset after a period of time, except after starting up the machine after a shutdown). Thus, if one or more counters have not exceeded the threshold, then game play continues at step 318. If, for example, a particular game experiences a certain type of fault or any fault more than the threshold number of times, control goes to step 326 where the gaming machine or the game is shutdown, in which case the game is disabled and not shown on a game menu. In other embodiments, instead of shutting down the game or machine, if the fault is related to a specific game, the gaming operator may be notified and a game is disabled manually instead of automatically as implied by the flow from step 316 to 326. In one embodiment, the gaming machine may be configured to isolate the game instance or game data that faulted for forensics and subsequent investigation. As noted above, the gaming machine may store the game information (persistent information such as meters and game states) to a separate memory or location. Once this is done, the gaming machine may allow another instance of the game to be played.

In other embodiments, methods and systems described above may be used for returning credits during online wager games and cloud-based wager games. For example, with cloud-based games, the game logic may run remotely over the Internet. When a player playing the game in a casino (or at home) experiences an error, in one embodiment the same steps described above may be applied. In another embodiment, different steps may be performed. For example, if the game crashes before the gaming device (client) shows any game information, the player can be switched to another server by the gaming network and continue playing the game. The player would not notice anything different about the game play, except possibly a small delay from when the player pressed a game start button and when the game started.

Figure 4:
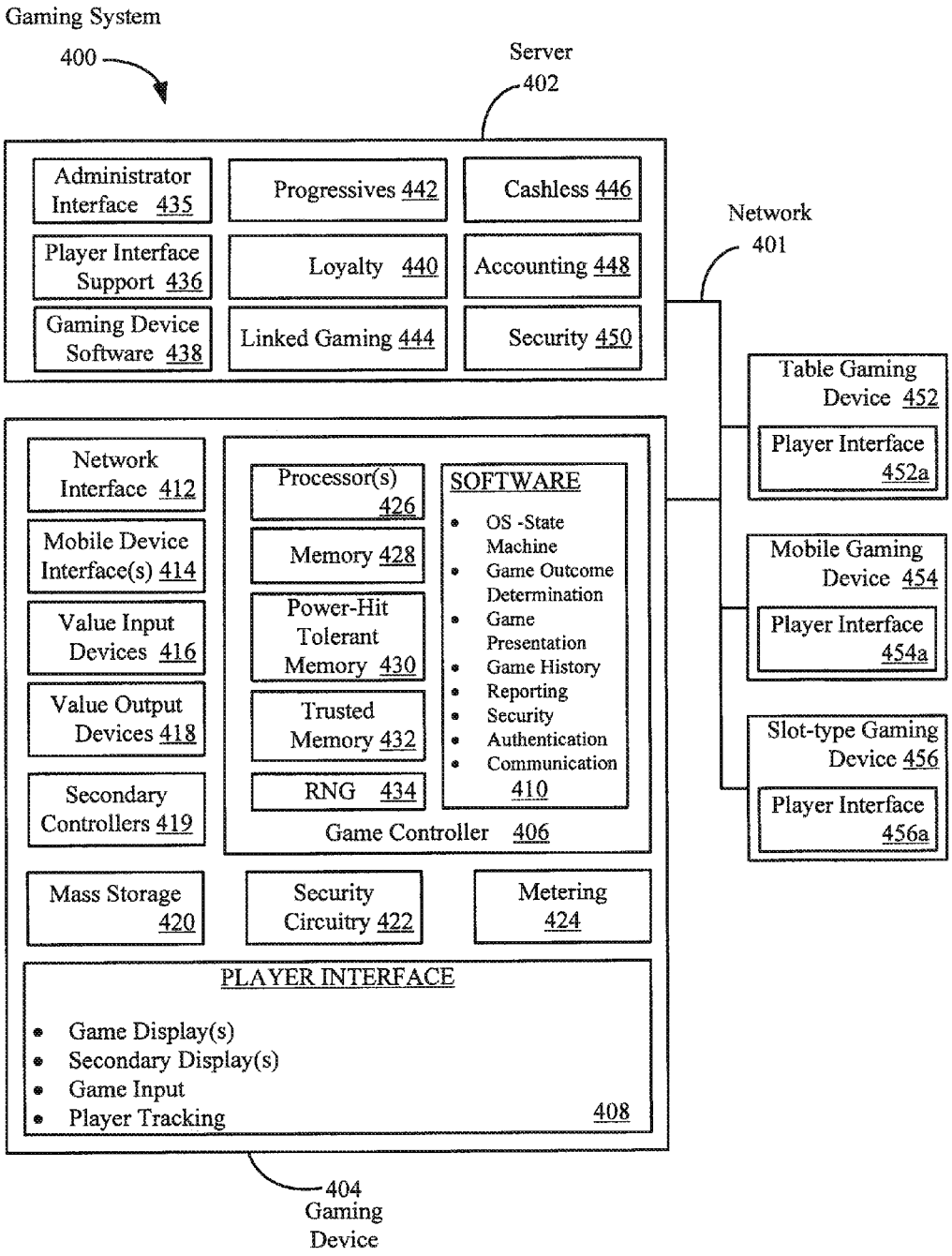
FIG. 4 shows a block diagram of a gaming system including a server and gaming devices in accordance with the described embodiments.

FIG. 4 shows a block diagram of a gaming system 400 in accordance with the described embodiments. The gaming system 400 can include one or more servers, such as server 402, and a variety of gaming devices including but not limited to table gaming devices, such as 452, mobile gaming devices, such as 454, and slot-type gaming devices, such as 456. The table gaming devices, such as 452, can include apparatus associated with table games where a live operator or a virtual operator is employed. The gaming devices and one or more servers can communicate with one another via a network 401. The network can include wired, wireless or a combination of wired and wireless communication connections and associated communication routers.

Some gaming devices, such as 452, 454 and 456, can be configured with a player interface that allows at least 1) selections, such as a wager amount, associated with a wager-based game to be made and 2) an outcome of the wager-based game to be displayed. As an example, gaming devices, 452, 454 and 456, include player interfaces, 452*a*, 454*a* and 456*a*, respectively. Typically, gaming devices with a player interface are located in publicly accessible areas, such as a casino floor. On the other hand, some gaming devices, such as server 402, can be located in publicly inaccessible areas, such is in a back-room of a casino or even off-site from the casino. Gaming devices located in publicly inaccessible areas may not include a player interface. For instance, server 402 does not include a player interface. However, server 402 includes an administrator interface 435 that allows functions associated with the server 402 to be adjusted.

An example configuration of a gaming device is described with respect to gaming device 404. The gaming device 404 can include 1) a game controller 406 for controlling a wager-based game played on the gaming device and 2) a player interface 408 for receiving inputs associated with the wager-based game and for displaying an outcome to the wager-based game. In more detail, the game controller 406 can include a) one or more processors, such as 426, b) memory for holding software executed by the one or more processors, such as 428, c) a power-hit tolerant memory, such as 430, d) one or more trusted memories, such as 432, e) a random number generator and f) a plurality of software applications, 410. The other gaming devices, including table gaming device 452, mobile gaming device 454, slot-type gaming device 456 and server 402, can each include a game controller with all or a portion of the components described with respect to game controller 406.

In particular embodiments, the gaming device can utilize a "state" machine architecture. In a "state" machine architecture critical information in each state is identified and queued for storage to a persistent memory. The architecture doesn't advance to the next state from a current state until all the critical information that is queued for storage for the current state is stored to the persistent memory. Thus, if an error condition occurs between two states, such as a power failure, the gaming device implementing the state machine can likely be restored to its last state prior to the occurrence of the error condition using the critical information associated with its last state stored in the persistent memory. This feature is often called a "roll back" of the gaming device. Examples of critical information can include but are not limited to an outcome determined for a wager-based game, a wager amount made on the wager-based game, an award amount associated with the outcome, credits available on the gaming device and a deposit of credits to the gaming device.

The power-hit tolerant memory 430 can be used as a persistent memory for critical data, such as critical data associated with maintaining a "state" machine on the gaming device. One characteristic of a power-hit tolerant memory 430 is a fast data transfer time. Thus, in the event of a power-failure, which might be indicated by a sudden power fluctuation, the critical data can be quickly loaded from volatile memory, such as RAM associated with the processor 426, into the power-hit tolerant memory 430 and saved.

In one embodiment, the gaming device 405 can be configured to detect power fluctuations and in response, trigger a transfer of critical data from RAM to the power-hit tolerant memory 430. One example of a power-hit tolerant memory 430 is a battery-backed RAM. The battery supplies power to the normally volatile RAM so that in the event of a power failure data is not lost. Thus, a battery-backed RAM is also often referred to as a non-volatile RAM or NV-RAM. An advantage of a battery-backed RAM is that the fast data transfer times associated with a volatile RAM can be obtained.

The trusted memory 432 is typically a read-only memory of some type that may be designed to be unalterable. An EPROM or EEPROM are two types of memory that can be used as a trusted memory 432. The gaming device 404 can include one or more trusted memories. Other types of memories, such as Flash memory, can also be utilized as an unalterable memory and the example of an EPROM or EEPROM is provided for purposes of illustration only.

Prior to installation the contents of a trusted memory, such as 432, can be verified. For instance, a unique identifier, such as a hash value, can be generated on the contents of the memory and then compared to an accepted hash value for the contents of the memory. The memory may not be installed if the generated and accepted hash values do not match. After installation, the gaming device can be configured to check the contents of the trusted memory. For instance, a unique identifier, such as a hash value, can be generated on contents of the trusted memory and compared to an expected value for the unique identifier. If the generated value of the unique identifier and the expected value of the unique identifier don't match, then an error condition can be generated on the gaming device 404. In one embodiment, the error condition can result in the gaming device entering a tilt state where game play is temporarily disabled on the gaming device.

Sometimes verification of software executed on the gaming device 404 can be performed by a regulatory body, such as a government agency. Often software used by a game controller, such as 406, can be highly regulated, where only software approved by a regulatory body is allowed to be executed by the game controller 406. In one embodiment, the trusted memory 432 can store authentication programs and/or authentication data for authenticating the contents of various memories on the gaming device 404. For instance, the trusted memory 432 can store an authentication program that can be used to verify the contents of a mass storage device, such as 420, which can include software executed by the game controller 406.

The random number generator (RNG) 434 can be used to generate random numbers that can be used to determine outcomes for a game of chance played on the gaming device. For instance, for a mechanical or video slot reel type of game, the RNG, in conjunction with a paytable that lists the possible outcomes for a game of chance and the associated awards for each outcome, can be used to generate random numbers for determining reel positions that display the randomly determined outcomes to the wager-based game. In other example, the RNG might be used to randomly select cards for a card game. Typically, as described above, the outcomes generated on a gaming device, such as 404, are considered critical data. Thus, generated outcomes can be stored to the power-hit tolerant memory 430.

Not all gaming devices may be configured to generate their own game outcomes and thus, may not use an RNG for this purpose. In some embodiments, game outcomes can be generated on a remote device, such as server 402, and then transmitted to the gaming device 404 where the outcome and an associated award can be displayed to the player via the player interface 408. For instance, outcomes to a slot-type game or a card game can be generated on server 402 and transmitted to the gaming device 404.

In other embodiments, the gaming device 404 can be used to play central determination games, such as bingo and lottery games. In a central determination game, a pool of game outcomes can be generated and then, particular game outcomes can be selected as needed (e.g., in response to a player requesting to play the central determination game) from the pool of previously generated outcomes. For instance, a pool of game outcomes for a central determination game can be generated and stored on server 402. Next, in response to a request to play the central determination game on gaming device 404, one of the outcomes from the pool can be downloaded to the gaming device 404. A game presentation including the downloaded outcome can be displayed on the gaming device 404.

In other embodiments, thin client type gaming devices, such as mobile gaming devices used to play wager-based video card or video slot games, may be configured to receive at least game outcomes from a remote device and not use an RNG to generate game outcomes locally. The game outcomes can be generated remotely in response to inputs made on the mobile device, such as an input indicating a wager amount and/or an input to initiate the game. This information can be sent from the mobile device to a remote device, such as from mobile gaming device 454 to server 402. After receiving the game outcome from the remote device, a game presentation for the game outcomes generated remotely can be generated and displayed on the mobile device. In some instances, the game presentation can also be generated remotely and then streamed for display to the mobile device.

The game controller 406 can be configured to utilize and execute many different types of software applications 410. Typically, the software applications utilized by the game controller 406 can be highly regulated and may undergo a lengthy approval process before a regulatory body allows the software applications to be utilized on a gaming device deployed in the field, such as in a casino. One type of software application the game controller can utilize is an Operating System (OS). The OS can allow various programs to be loaded for execution by the processor 426, such as programs for implementing a state machine on the gaming device 406. Further, the OS can be used to monitor resource utilization on the gaming device 406. For instance, certain applications, such as applications associated with game outcome generation and game presentation that are executed by the OS can be given higher priority to resources, such as the processor 426 and memory 428, than other applications that can be executing simultaneously on the gaming device.

As previously described, the gaming device 404 can execute software for determining the outcome of a wager-based game and generating a presentation of the determined game outcome including displaying an award for the game. As part of the game outcome presentation one or more of 1) electro-mechanical devices, such as reels or wheels, can be actuated, 2) video content can be output to video displays, 3) sounds can be output to audio devices, 4) haptic responses can be actuated on haptic devices or 5) combinations thereof, can be generated under control of the game controller 406. The peripheral devices used to generate components of the game outcome presentation can be associated with the player interface 408 where the types of devices that are utilized for the player interface 608 can vary from device to device.

To play a game, various inputs can be required. For instance, via input devices coupled to the gaming device 404, a wager amount can be specified, a game can be initiated or a selection of a game choice associated with the play of the game can be made. The software 410 executed by the game controller 406 can be configured to interpret various signals from the input devices, such as signals received from a touch screen controller or input buttons, and affect the game played on the gaming device in accordance with the received input signals. The input devices can also be part of the player interface 408 provided with the gaming device, such as 404.

In other embodiments, the gaming software 410 executed by the game controller 406 can include applications that allow a game history including the results of a number of past games to be stored, such as the previous 10 or 100 games played on the gaming device 404. The game history can be stored to a persistent memory including but not limited to the power-hit tolerant memory 430. The gaming controller 406 can configured to provide a menu (typically, only operator accessible), that allows the results of a past game to be displayed via the player interface 408. The output from the history menu can include a re-creation of the game presentation associated with a past game outcome, such as a video representation of card hand associated with a video poker game, a video representation of a reel configuration associated with a video slot game, and/or raw data associated with the past game result, such as an award amount, an amount wagered, etc. The history menu can be used for dispute resolution purposes, such as if a player complains that they have not been properly awarded for a game previously played on the gaming device 404.

The reporting software can be used by the game controller 406 to report events that have occurred on the gaming device 404 to remote device, such as server 402. For instance, in one embodiment, the game controller 406 can be configured to report error conditions that have been detected on the gaming device 404, such as if a device has malfunctioned or needs attention. For instance, the reporting software can be used to send a message from the gaming device 404 to the server 402 indicating that a printer on the gaming device needs a refill of tickets. In another embodiment, the gaming controller 406 can be configured to report security events that may have occurred on the gaming device 404, such as but not limited to if a door is opened, a latch is activated or an interior portion of the gaming device 404 has been accessed.

In yet other embodiments, the game controller 406 can be configured to report gaming activity and associated events that has been generated on the gaming device, such as a deposit of cash or an indicia of credit, at the gaming device, a generation of game outcome including an associated award amount and a dispensation of cash or an indicia of credit from the gaming device 404. As part of a loyalty program, the gaming activity can be associated with a particular player. The reporting software can include player tracking elements that allow the gaming activity of a particular player to be reported to a remote device, such as server 402.

The game controller 406 can execute the authentication software to verify the authenticity of data and/or software programs executed on the gaming device 404. For instance, the authentication software can be used to verify the authenticity of data and/or software applications when they are first downloaded to the gaming device 404. Further, the authentication software can be used to periodically verify the authenticity of data and/or software applications currently residing on the gaming device, such as software applications stored on one of the memories coupled to the gaming device 404 including applications loaded into the memory 428 for execution by the processor 426.

The communication software executed by the game controller 406 can be used to communicate with a variety of devices remote to the gaming device 404. For instance, the communication software can be used to communicate with one or more of a) servers remote to the device, such as 402, b) other gaming devices, such as table gaming device 452, mobile gaming device 454 and slot-type gaming device 456 and c) mobile devices carried by casino personnel or players in the vicinity of the gaming device 404. Via the communication software, the game controller can be configured to communicate via many different communication protocols. For instance, different wireless and/or wired communication protocols can be implemented. Further, proprietary or non-proprietary gaming specific protocols can be implemented. For instance, gaming specific non-proprietary communication protocols, such as G2S (game to system), GDS (gaming device standard) and S2S (system to system) communication protocols provided by the Gaming Standards Association (GSA), Fremont, Calif., can be implemented on the gaming devices described herein.

The gaming device 404 can communicate with one or more remote devices via one or more network interfaces, such as 412. For instance, via network interfaces 412 and the network 401, the gaming device 404 can communicate with other gaming devices, such as server 402 and/or gaming devices, 452, 454 and 456. The network interfaces can provide wired or wireless communications pathways for the gaming device 404. Some gaming devices may not include a network interface or can be configured to operate in a stand-alone mode where the network interface is not connected to a network.

In other embodiments, a mobile device interface or interfaces, such as 414, can be provided for communicating with a mobile device, such as a cell phone or a tablet computer carried by players or casino personnel temporarily in the vicinity of the gaming device 404. A wireless communication protocol, such as Bluetooth™ and a Wi-Fi compatible standard, can be used for communicating with the mobile devices via the mobile device interfaces 414. In one embodiment, the mobile device interface can implement a short range communication protocol, such as a near-field communication (NFC) protocol used for mobile wallet applications. NFC is typically used for communication distances of 4 cm or less. In addition, a wired communication interface, such as a docking station, can be integrated into the gaming device, such as 404. The wired communication interface can be configured to provide communications between the gaming device 404 and the mobile device and/or providing power to the mobile device.

The gaming device 404 can include one or more each of value input devices 416 and value output device 418. The value input devices 416 can be used to deposit cash or indicia of credit onto the gaming device. The cash or indicia of credit can be used to make wagers on games played on the gaming device 404. Examples of value input devices 416 include but are not limited to a magnetic-striped card or smart card reader, a bill and/or ticket acceptor, a network interface for downloading credits from a remote source, a wireless communication interface for reading credit data from nearby devices and a coin acceptor. A few examples of value input devices are shown in FIG. 7.

Figure 5:
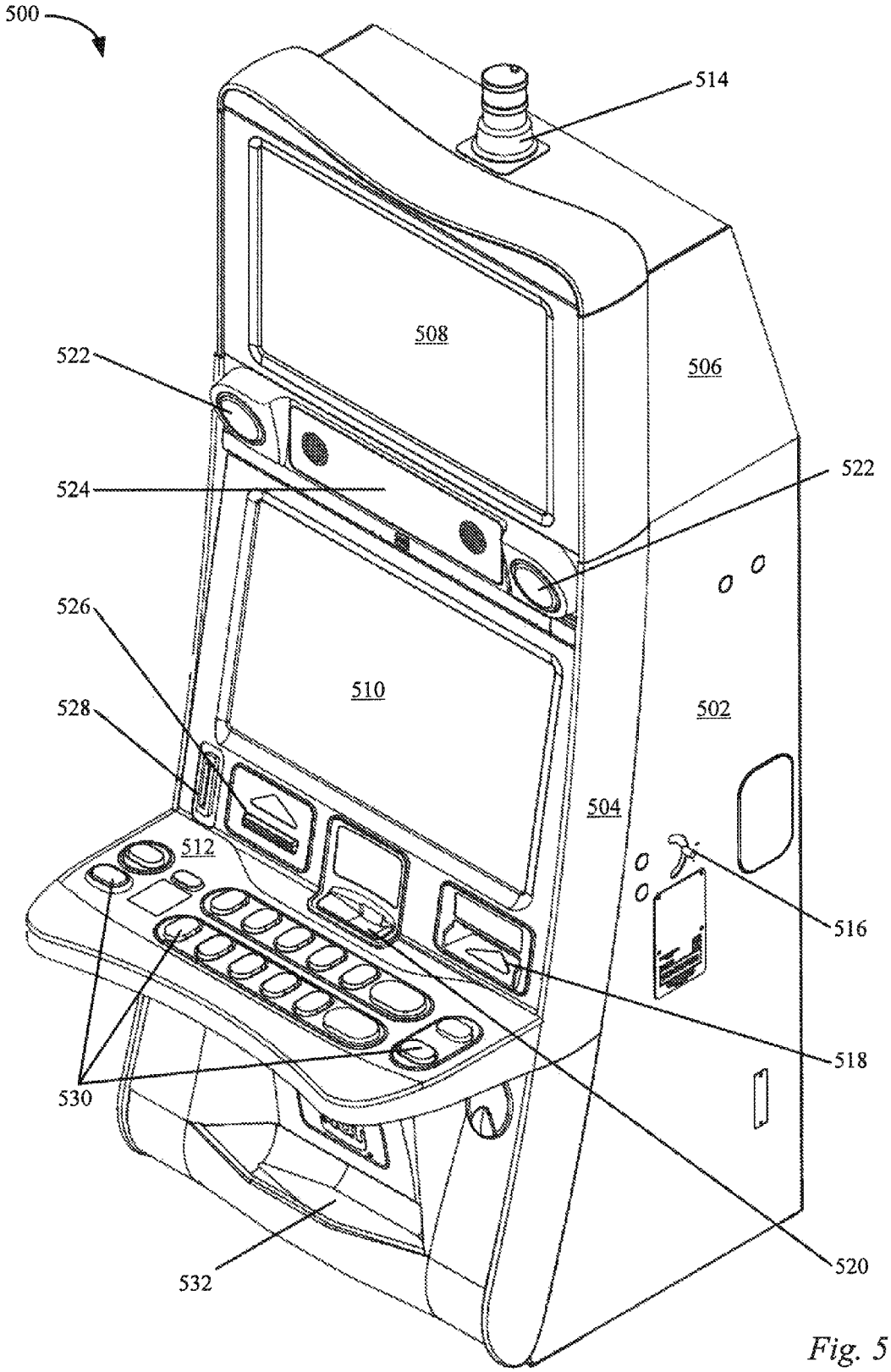
FIG. 5 shows a perspective drawing of a gaming device in accordance with the described embodiments

The value output devices can be used to dispense cash or indicia of credit from the gaming device 404. Typically, the indicia of credit can be exchanged for cash. For instance, the indicia of credit can be exchanged at a cashier station or at a redemption station. Examples of value output devices can include a network interface for transferring credits into a remote account, a wireless communication interface that can be used with a mobile device implementing mobile wallet application, a coin hopper for dispensing coins or tokens, a bill dispenser, a card writer, a printer for printing tickets or cards redeemable for cash or credits. Another type of value output device is a merchandise dispenser, which can be configured to dispense merchandise with a tangible value from a gaming device. A few examples of value output devices are shown in FIG. 5.

The combination of value input devices 416 and value output devices 418 can vary from device to device. In some embodiments, a gaming device 404 may not include a value input device or a value output device. For instance, a thin-client gaming device used in a mobile gaming application may not include a value input device and a value output device. Instead, a remote account can be used to maintain the credits won or lost from playing wager-based games via the mobile device. The mobile device can be used to access the account and affect the account balance via game play initiated on the mobile device. Credits can be deposited or withdrawn from the remote account via some mechanism other than via the mobile device interface.

In yet other embodiments, the gaming device 404 can include one or more secondary controllers 419. The secondary controllers can be associated with various peripheral devices coupled to the gaming device, such as the value input devices and value output devices described in the preceding paragraphs. As another example, the secondary controllers can be associated with peripheral devices associated with the player interface 408, such as input devices, video displays, electro-mechanical displays and a player tracking unit. In some embodiments, the secondary controllers can receives instructions and/or data from and provide responses to the game controller 406. The secondary controller can be configured to interpret the instructions and/or data from the game controller 406 and control a particular device according to the received instructions and/or data. For instance, a print controller may receive a print command with a number of parameters, such as a credit amount and in response print a ticket redeemable for the credit amount. In another example, a touch screen controller can detect touch inputs and send information to the game controller 406 characterizing the touch input.

In a particular embodiment, a secondary controller can be used to control a number of peripheral devices independently of the game controller 406. For instance, a player tracking unit can include one or more of a video display, a touch screen, card reader, network interface or input buttons. A player tracking controller can control these devices to provide player tracking services and bonusing on the gaming device 404. In alternate embodiments, the game controller 404 can control these devices to perform player tracking functions. An advantage of performing player tracking functions via a secondary controller, such as a player tracking controller, is that since the player tracking functions don't involve controlling the wager-based game, the software on the player tracking unit can be developed modified via a less lengthy and regulatory intensive process than is required for software executed by the game controller 406, which does control the wager-based game. In general, using a secondary controller, certain functions of the gaming device 404 that are not subject to as much regulatory scrutiny as the game play functions can be decoupled from the game controller 406 and implemented on the secondary controller instead. An advantage of this approach, like for the player tracking controller, is that software approval process for the software executed by the secondary controller can be less intensive than the process needed to get software approved for the game controller.

A mass storage unit(s) 420, such as a device including a hard drive, optical disk drive, flash memory or some other memory storage technology can be used to store applications and data used and/or generated by the gaming device 404. For instance, a mass storage unit, such as 420, can be used to store gaming applications executed by the game controller 406 where the gaming device 404 can be configured to receive downloads of game applications from remote devices, such as server 402. In one embodiment, the game controller 406 can include its own dedicated mass storage unit. In another embodiment, critical data, such as game history data stored in the power-hit tolerant memory 430 can be moved from the power-hit tolerant memory 430 to the mass storage unit 420 at periodic intervals for archival purposes and to free up space in the power-hit tolerant memory 430.

The gaming device 404 can include security circuitry 422, such as security sensors and circuitry for monitoring the sensors. The security circuitry 422 can be configured to operate while the gaming device is receiving direct power and operational to provide game play as well as when the gaming device is uncoupled from direct power, such as during shipping or in the event of a power failure. The gaming device 404 can be equipped with one or more secure enclosures, which can include locks for limiting access to the enclosures. One or more sensors can be located within the secure enclosures or coupled to the locks. The sensors can be configured to generate signals that can be used to determine whether secure enclosures have been accessed, locks have been actuated or the gaming device 404, such as a mobile device has been moved to an unauthorized area. The security monitoring circuitry can be configured to generate, store and/or transmit error events when the security events, such as accessing the interior of the gaming device, have occurred. The error events may cause the game controller 406 to place itself in a "safe" mode where no game play is allowed until the error event is cleared.

The server 402 can be configured to provide one or more functions to gaming devices or other servers in a gaming system 400. The server 402 is shown performing a number of different functions. However, in various embodiments, the functions can be divided among multiple servers where each server can communicate with a different combination of gaming devices. For instance, player interface support 436 and gaming device software 438 can be provided on a first server, progressives can be provided on a second server, loyalty program functions 440 and accounting 448 can be provided on a third server, linked gaming 444 can be provided on a fourth server, cashless functions 446 can be provided on a fifth server and security functions 450 can be provided on a sixth server. In this example, each server can communicate with a different combination of gaming devices because each of the functions provided by the servers may not be provided to every gaming device in the gaming system 400. For instance, the server 402 can be configured to provide progressive gaming functions to gaming devices 404, 452 and 456 but not gaming device 454. Thus, the server 402 may not communicate with the mobile gaming device 454 if progressive functions are not enabled on the mobile gaming device at a particular time.

Typically, each server can include an administrator interface that allows the functions of a server, such as 402, to be configured and maintained. Each server 402 can include a processor and memory. In some embodiments, the servers, such as 402, can include a game controller with components, such as but not limited to a power-hit tolerant memory 430, a trusted memory 432 and an RNG 434 described with respect to gaming device 404. The servers can include one or more network interfaces on which wired or wireless communication protocols can be implemented. Next, some possible functions provided by the server 402 are described. These functions are described for the purposes of illustration only and are not meant to be limiting.

The player interface support 436 can be used to serve content to gaming devices, such as 404, 452, 454 and 456, remote to the server. The content can include video and audio content that can be output on one of the player interfaces, such as 408, 452*a*, 454*a* and 456*a*. Further, the content can be configured to utilize unique features of a particular player interface, such as video displays, wheels or reels, if the particular player interface is so equipped.

In one embodiment, via the player interface support, content can be output to all or a portion of a primary video display that is used to output wager-based game outcomes on a player interface associated with a gaming device. For instance, a portion of the primary display can be allocated to providing a "service window" on the primary video display where the content in the service window is provided from a server remote to the gaming device. In particular embodiments, the content delivered from the server to a gaming device as part of the player interface support 436 can be affected by inputs made on the gaming device. For instance, the service window can be generated on a touch screen display where inputs received via the service window can be sent back to server 402. In response, to the received inputs, the server 402 can adjust the content that is displayed on the remote gaming device that generated the inputs.

If a player's identity is known, then the player interface support 436 can be used to provide custom content to a remote gaming device, such as 404. For instance, a player can provide identification information, such as information indicating their membership in a loyalty program, during their utilization of a gaming device. The custom content can be selected to meet the identified player's interests. In one embodiment, the player's identity and interests can be managed via a loyalty program, such as via a loyalty program account associated with loyalty function 440. The custom content can include notifications, advertising and specific offers that are determined to be likely of interest to a particular player.

The gaming device software function 438 can be used to provide downloads of software for the game controller and/or second controllers associated with peripheral devices on a gaming device. For instance, the gaming device software 438 may allow an operator and/or a player to select a new game for play on a gaming device. In response to the game selection, the gaming device software function 438 can be used to download game software that allows a game controller to generate the selected game. In another example, in response to determining that a new counterfeit bill is being accepted by bill acceptors in the gaming system 400, the gaming device software function 438 can be used to download a new detection algorithm to the bill acceptors that allow the counterfeit bill to be detected.

The progressive gaming function 442 can be used to implement progressive game play on one or more gaming devices. In progressive game play, a portion of wagers associated with the play of a progressive game is allocated to a progressive jackpot. A group of gaming devices can be configured to support play of the progressive game and contribute to the progressive jackpot. In various embodiments, the gaming devices contributing to a progressive jackpot may be a group of gaming devices collocated near one another, such as a bank of gaming machines on a casino floor, a group of gaming devices distributed throughout a single casino, or group of gaming devices distributed throughout multiple casinos (e.g., a wide area progressive). The progressive gaming function 442 can be used to receive the jackpot contributions from each of the gaming devices participating in the progressive game, determine a current jackpot and notify participating gaming devices of the current progressive jackpot amount, which can be displayed on the participating gaming devices if desired.

The loyalty function 440 can be used to implement a loyalty program within a casino enterprise. The loyalty function 440 can be used to receive information regarding activities within a casino enterprise including gaming and non-gaming activities and associate the activities with particular individuals. The particular individuals can be known or may be anonymous. The loyalty function 440 can used to store a record of the activities associated with the particular individuals as well as preferences of the individuals if known. Based upon the information stored with the loyalty function 440 comps (e.g., free or discounted services including game play), promotions and custom contents can be served to the particular individuals.

The linked gaming function 444 can be used to used provide game play activities involving player participating as a group via multiple gaming devices. An example, a group of player might be competing against one another as part of a slot tournament. In another example, a group of players might be working together in attempt to win a bonus that can be shared among the players.

The cashless function 446 can enable the redemption and the dispensation of cashless instruments on a gaming device. For instance, via the cashless function, printed tickets, serving as a cashless instrument, can be used to transfer credits from one gaming device to another gaming device. Further, the printed tickets can be redeemed for cash. The cashless function can be used to generate identifying information that can be stored to a cashless instrument, such as a printed ticket, that allows the instrument to later be authenticated. After authentication, the cashless instrument can be used for additional game play or redeemed for cash.

The accounting function can receive transactional information from various gaming devices within the gaming system 400. The transactional information can relate to value deposited on each gaming device and value dispensed from each gaming device. The transactional information, which can be received in real-time, can be used to assess the performance of each gaming device as well as an overall performance of the gaming system. Further, the transactional information can be used for tax and auditing purposes.

The security function 450 can be used to combat fraud and crime in a casino enterprise. The security function 450 can be configured to receive notification of a security event that has occurred on a gaming device, such as an attempt at illegal access. Further, the security function 450 can receive transactional data that can be used to identify if gaming devices are being utilized in a fraudulent or unauthorized manner. The security function 450 can be configured to receive, store and analyze data from multiple sources including detection apparatus located on a gaming device and detection apparatus, such as cameras, distributed throughout a casino. In response to detecting a security event, the security function 450 can be configured to notify casino personnel of the event. For instance, if a security event is detected at a gaming device, a security department can be notified. Depending on the security event, one or more team members of the security department can be dispatched to the vicinity of the gaming device. Next, a perspective diagram of a slot-type gaming device that can include all or a portion of the components described with respect to gaming device 404 is described.

FIG. 5 shows a perspective drawing of a gaming device 500 in accordance with the described embodiments. The gaming device 500 is example of what can be considered a "thick-client." Typically, a thick-client is configurable to communicate with one or more remote servers but provides game play, such as game outcome determination, independent of the remote servers. In addition, a thick-client can be considered as such because it includes cash handling capabilities, such as peripheral devices for receiving cash, and a secure enclosure within the device for storing the received cash. In contrast, thin-client device, such as a mobile gaming device, may be more dependent on a remote server to provide a component of the game play on the device, such as game outcome determination, and/or may not include peripheral devices for receiving cash and an associated enclosure for storing it.

Many different configurations are possible between thick and thin clients. For instance, a thick-client device, such as 500, deployed in a central determination configuration, may receive game outcomes from a remote server but still provide cash handling capabilities. Further, the peripheral devices can vary from gaming device to gaming device. For instance, the gaming device 500 can be configured with electro-mechanical reels to display a game outcome instead of a video display, such as 510. Thus, the features of gaming device 500 are described for the purposes of illustration only and are not meant to be limiting.

The gaming device 500 can include a main cabinet 502. The main cabinet 502 can provide a secure enclosure that prevents tampering with the device components, such as a game controller (not shown) located within the interior of the main cabinet and cash handing devices including a coin acceptor 520, a ticket printer 526 and a bill acceptor 518. The main cabinet can include an access mechanism, such as door 504, which allows an interior of the gaming device 500 to be accessed. The actuation of the door 504 can be controlled by a locking mechanism, such as lock 516. The lock 516, the door 504 and the interior of the main cabinet 502 can be monitored with security sensors for detecting whether the interior has been accessed. For instance, a light sensor can be provided to detect a change in light-level in response to the door 504 being opened.

The interior of the main cabinet 500 can include additional secure enclosure, which can also be fitted with locking mechanisms. For instance, the game controller, such as game controller 406, shown in FIG. 4, can be secured within a separate locked enclosure. The separate locked enclosure for the game controller may allow maintenance functions to be performed on the gaming device, such as emptying a drop box for coins, emptying a cash box or replacing a device, while preventing tampering with the game controller. Further, in the case of device with a coin acceptor, 520, the separate enclosure can protect the electronics of the game controller from potentially damaging coin dust.

A top box 506 can be mounted to the top of the main cabinet 502. A number of peripheral devices can be coupled to the top box 506. In FIG. 5, a display device 508 and a candle device 514 are mounted to the top box 506. The display device 508 can be used to display information associated with game play on the gaming device 500. For instance, the display device 508 can be used to display a bonus game presentation associated with the play of a wager-based game (One or more bonus games are often features of many wager-based games). In another example, the display device 508 can be used to display information associated with a progressive game, such as one or more progressive jackpot amounts. In yet another example, the display device 508 can be used to display an attract feature that is intended to draw a potential player's attention to the gaming device 500 when it is not in use.

The candle device 514 can include a number of lighting elements. The lighting elements can be lit in different patterns to draw attention to the gaming device. For instance, one lighting pattern may indicate that service is needed at the gaming device 500 while another light pattern may indicate that a player has requested a drink. The candle device 514 is typically placed at the top of gaming device 500 to increase its visibility. Other peripheral devices, including custom bonus devices, such as reels or wheels, can be included in a top box 506 and the example in FIG. 5 is provided for illustrative purposes only. For instance, some of the devices coupled to the main cabinet 502, such as printer 526, can be located in a different top box configuration.

The gaming device 500 provides a player interface that allows the play of a game, such as wager-based game. In this embodiment, the player interface includes 1) a primary video display 510 for outputting video images associated with the game play, 2) audio devices, such as 522, for outputting audio content associated with game play and possibly casino operations, 3) an input panel 512 for at least providing game play related inputs and 4) a secondary video display 508 for outputting video content related to the game play (e.g., bonus material) and/or the casino enterprise (e.g., advertising). In particular embodiments, one or both of the video displays, 508 and 510, can be equipped with a touch screen sensor and associated touch screen controller, for detecting touch inputs, such as touch inputs associated with the play of a game or a service window output to the display device.

The input panel 512 can include a number of electro-mechanical input buttons, such as 530, and/or touch sensitive surfaces. For instance, the input panel can include a touch screen equipped video display to provide a touch sensitive surface. In some embodiments, the functions of the electro-mechanical input buttons can be dynamically reconfigurable. For instance, the function of the electro-mechanical input buttons may be changed depending on the game that is being played on the gaming device. To indicate function changes, the input buttons can each include a configurable display, such as an e-ink or a video display for indicating the function of button. The output of the configurable display can be adjusted to account for a change in the function of the button.

The gaming device 500 includes a card reader 528, a printer 526, a coin acceptor 520, a bill and/or ticket acceptor 520 and a coin hopper (not shown) for dispensing coins to a coin tray 532. These devices can provide value input/output capabilities on the gaming device 500. For instance, the printer 526 can be used to print out tickets redeemable for cash or additional game play. The tickets generated by printer 526 as well as printers on other gaming devices can be inserted into bill and ticket acceptor 518 to possibly add credits to the gaming device 500. After the ticket is authenticated, credits associated with the ticket can be transferred to the gaming device 500.

The device 518 can also be used to accept cash bills. After the cash bill is authenticated, it can be converted to credits on the gaming device and used for wager-based game play. The coin acceptor 520 can be configured to accept coins that are legal tender or tokens, such as tokens issued by a casino enterprise. A coin hopper (not shown) can be used to dispense coins that are legal tender or tokens into the coin tray 532.

The various aspects, embodiments, implementations or features of the described embodiments can be used separately or in any combination. Various aspects of the described embodiments can be implemented by software, hardware or a combination of hardware and software. The computer readable medium is any data storage device that can store data which can thereafter be read by a computer system. Examples of the computer readable medium include read-only memory, random-access memory, CD-ROMs, DVDs, magnetic tape and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

While the embodiments have been described in terms of several particular embodiments, there are alterations, permutations, and equivalents, which fall within the scope of these general concepts. It should also be noted that there are many alternative ways of implementing the methods and apparatuses of the present embodiments. It is therefore intended that the following appended claims be interpreted as including all such alterations, permutations, and equivalents as fall within the true spirit and scope of the described embodiments.

What is claimed is:

1. A method of returning credits to a patron playing a wager game on a gaming machine when a fault occurs during game play, the method implemented on the gaming machine, comprising:

storing an initial credit amount and a bet amount in a non-volatile memory;

detecting an error during game play of the wager game;

calculating a return credit amount;

presenting the patron a query having an option to accept the return credit amount and an option to call an attendant;

receiving a selection from the patron to accept the return credit amount;

returning the return credit amount to the patron;

determining an error type of the error;

updating a type-specific counter based on the detecting of the error and the determining the error type;

determining that the type-specific counter exceeds a threshold value; and disabling the game play of the wager game on the game machine in response to determining that the type-specific counter exceeds the threshold value.

2. A method as recited in claim 1 further comprising:
transmitting a game start event to a host server.

3. A method as recited in claim 2 wherein enabling continued game play on the gaming machine further comprises:
transmitting a game end event to the host server.

4. A method as recited in claim 1 further comprising:
storing a win amount and a bonus amount in the non-volatile memory.

5. A method as recited in claim 1 further comprising:
saving game state data relating to the error for game failure investigation.

6. A method as recited in claim 1 further comprising:
classifying the error.

7. A method as recited in claim 1 further comprising:
reconciling one or more credit amounts with a host server.

8. A method as recited in claim 1 further comprising:
executing game logic on a remote server.

9. A method as recited in claim 1 wherein calculating a return credit amount is performed on a remote server on the Internet.

10. A method as recited in claim 1 further comprising:
updating error data related to the wager game.

11. The method of claim 1, further comprising enabling continued game play on the gaming machine.

12. A method of processing an error during game play on a gaming machine, the method implemented on the gaming machine, comprising:
executing a first game on the gaming machine;
stopping the game due to a fault;
calculating a credit amount to return to a player of the game;
displaying the credit amount on the gaming machine;
presenting the player a query having an option to accept the credit amount and an option to call an attendant;
detecting a response from the player in regards to the query;
determining a fault type of the fault;
updating a type-specific counter based on the determining of the fault type;
determining that the type-specific counter exceeds a threshold value;
disabling the game play of the first game on the game machine in response to determining that the type-specific counter exceeds the threshold value; and
executing a second game on the gaming machine.

13. A method as recited in claim 12 further comprising:
updating error data related to the first game.

14. A method as recited in claim 12 further comprising:
determining a total value of the credit amount to be returned; and
prompting for an attendant if the total value exceeds a threshold value.

15. A method as recited in claim 12 further comprising:
transmitting a game start event to a host server; and
indicating a game end event to the host server by reversing actions on the gaming machine caused by the first game.

16. A method as recited in claim 12 further comprising:
reconciling credit-related data between the gaming machine and a host server.

17. A method as recited in claim 12 further comprising:
executing game logic for the first game and the second game on a remote server on the Internet.

* * * * *